US007182092B1

(12) United States Patent
Cantwell

(10) Patent No.: US 7,182,092 B1
(45) Date of Patent: Feb. 27, 2007

(54) TENT EVE

(75) Inventor: Robert Cantwell, Leslie, MO (US)

(73) Assignee: North Pole Limited, Kowloon (HK)

( * ) Notice: Subject to any disclaimer, the term of this patent is extended or adjusted under 35 U.S.C. 154(b) by 148 days.

(21) Appl. No.: 10/769,040

(22) Filed: Jan. 30, 2004

(51) Int. Cl.
*E04H 15/58* (2006.01)

(52) U.S. Cl. ..... 135/156; 135/117

(58) Field of Classification Search ..... 135/156, 135/158, 160, 117
See application file for complete search history.

(56) References Cited

U.S. PATENT DOCUMENTS

| | | | | | |
|---|---|---|---|---|---|
| 758,033 | A * | 4/1904 | Holmes | 52/63 |
| 998,915 | A * | 7/1911 | McMillin | 135/94 |
| 1,856,658 | A * | 5/1932 | Harding | 135/93 |
| 1,900,274 | A * | 3/1933 | Brockie | 135/147 |
| 2,022,211 | A * | 11/1935 | Leffert | 135/121 |
| 2,942,609 | A * | 6/1960 | Ferguson | 135/116 |
| 3,621,857 | A * | 11/1971 | May et al. | 135/94 |
| 3,670,747 | A * | 6/1972 | Pohl et al. | 135/94 |
| 3,943,952 | A * | 3/1976 | Marquart et al. | 135/93 |
| 4,078,572 | A * | 3/1978 | Moss | 135/97 |
| 4,285,355 | A * | 8/1981 | Lundblade | 135/147 |
| 4,703,769 | A * | 11/1987 | Harrison, Jr. | 135/67 |
| 5,638,850 | A * | 6/1997 | Hazinski et al. | 135/120.1 |
| 6,463,948 | B2 * | 10/2002 | Lee | 135/156 |
| 6,499,497 | B1 * | 12/2002 | Swetish et al. | 135/115 |
| 6,763,841 | B1 * | 7/2004 | Cantwell | 135/117 |
| 2004/0238021 | A1 * | 12/2004 | Holub et al. | 135/97 |

FOREIGN PATENT DOCUMENTS

| | | | |
|---|---|---|---|
| EP | 351390 | * | 1/1990 |

* cited by examiner

*Primary Examiner*—Janet M. Wilkens
(74) *Attorney, Agent, or Firm*—Armstrong Teasdale LLP

(57) ABSTRACT

A tent including a fabric enclosure forming a plurality of walls and defining an interior of the tent. A frame is positioned with respect to the fabric enclosure and is configured to support the fabric enclosure. At least one eve portion is coupled to the frame and extends outwardly from a first wall of the plurality of walls. A cover is coupled to the frame and the at least one eve portion. The cover is configured to cover at least a portion of the fabric enclosure.

17 Claims, 1 Drawing Sheet

TENT EVE

FIELD

The present invention relates generally to tents, and more particularly to tent eves.

BACKGROUND

Tents provide temporary shelter to campers and backpackers. However, in conventional tents, weathering elements such as sun and rain can beat against the tent, especially when the tent rainfly is removed, making for unpleasant living conditions inside the tent and increasing the wear on the tent. An improved structure that reduces the weathering effects on a tent is needed.

SUMMARY

The invention overcomes the identified limitations and provides a tent eve for rain and sun protection.

An exemplary embodiment of a tent eve includes a frame configured to extend over a tent and beyond tent side walls, and a cover coupled to the frame configured to cover area spanned by the frame.

In one aspect of the invention, frame ends extending beyond the tent side walls are straight. In another aspect of the invention, the frame ends extending beyond the tent side walls are curved. In another aspect of the invention, the tent eve is configured to reduce rainfall contact with the tent side walls. In another aspect of the invention, the tent eve is configured to provide additional shading from the sun to prevent ultra-violet (UV) degradation of the tent side walls.

Advantages of the invention include the ability to protect the tent from rainfall and UV degradation.

DRAWINGS

Figure 2:
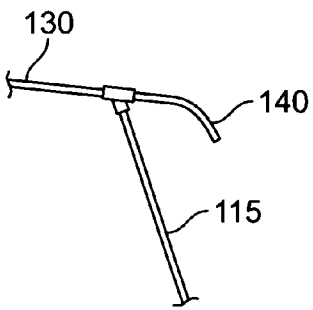
Figure 1:
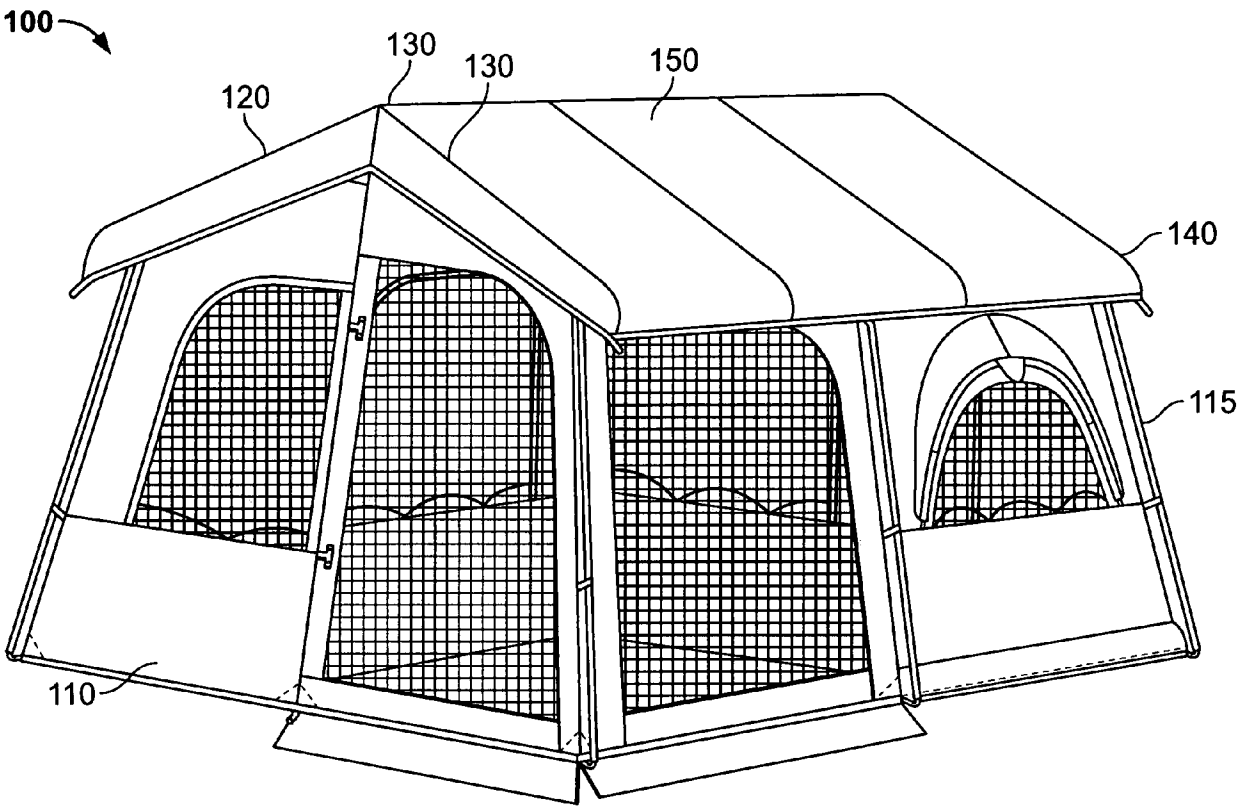

The invention will be described with reference to the drawings, in which:

FIG. 1 is a perspective view showing a combination of a tent with a tent eve, according to an embodiment of the invention; and FIG. 2 is a detailed view showing a tent eve frame end, according to an embodiment of the invention.

DETAILED DESCRIPTION

Exemplary embodiments are described herein to provide a detailed description of the invention. Variations of these embodiments will be apparent to those of skill in the art. For example, the invention is described with reference to a tent eve, but the invention may also apply to eves for other types of structures, such as permanent structures or doghouses.

FIG. 1 is a perspective view showing a combination of a tent 110 with a tent eve 120, according to an embodiment of the invention. In the embodiment, the tent eve 120 includes a frame 130 configured to extend over the tent 110 and beyond tent side walls 115, and a cover 150 coupled to the frame 130 configured to cover an area spanned by the frame 130. Also in the embodiment, frame ends 140 extend beyond the tent side walls 115.

Because the tent eve 120 extends beyond the tent side walls 115, the tent eve 120 reduces rainfall contact with the tent side walls 115. The tent eve 120 also provides additional shading to the tent 110 from the sun. This shade may prevent ultra-violet (UV) degradation of the tent side walls 115, and may also provide a cooler environment inside the tent 110 for the campers.

FIG. 2 is a detailed view showing a tent eve frame end 140, according to an embodiment of the invention. In the embodiment shown, the frame ends 140 are curved. Alternatively, the frame ends 140 may be straight, angled or any other appropriate shape.

Advantages of the invention include the ability to protect the tent from rainfall and UV degradation.

Having disclosed exemplary embodiments and the best mode, modifications and variations may be made to the disclosed embodiments while remaining within the subject and spirit of the invention as defined by the following claims.

The invention claimed is:

1. A tent comprising:

a fabric enclosure forming a plurality of walls and defining an interior of said tent;

a frame positioned with respect to said fabric enclosure and configured to support said fabric enclosure;

a first plurality of eve portions each coupled to said frame and extending outwardly from a first wall of said plurality of walls;

a second plurality of eve portions each coupled to said frame and extending outwardly from a second wall of said plurality of walls; and a cover coupled to said frame and each said eve portion, said cover configured to cover at least a portion of said fabric enclosure, each said eve portion coupled to a first frame member of said frame, and at least a portion of each said eve portion aligned coaxially with said first frame member.

2. A tent in accordance with claim 1 wherein said first frame member is positioned with respect to a roof panel formed by said fabric enclosure.

3. A tent in accordance with claim 1 wherein each of said first frame member and each said eve portion is positioned within a coupling device.

4. A tent in accordance with claim 3 further comprising a second frame member having an upper end portion positioned within said coupling device, said second frame member positioned with respect to said first wall.

5. A tent in accordance with claim 1 wherein each said eve portion is straight.

6. A tent in accordance with claim 1 wherein each said eve portion is curved.

7. A tent in accordance with claim 1 wherein said tent eve is configured to reduce rainfall contact with said first wall.

8. A tent in accordance with claim 1 wherein said tent eve is configured to provide shading to said tent from light.

9. A tent in accordance with claim 8 wherein the shading prevents ultra-violet degradation of said first wall.

10. A tent comprising:

a fabric enclosure forming a plurality of walls and defining an interior of said tent;

a frame positioned with respect to said fabric enclosure and configured to support said fabric enclosure;

a first plurality of curved eve portions each coupled to said frame and extending outwardly from a first wall of said plurality of walls;

a second plurality of curved eve portions each coupled to said frame and extending outwardly from a second wall of said plurality of walls; and a cover coupled to said frame and each said curved eve portion, said cover configured to cover at least a portion of said fabric enclosure.

11. A tent comprising:

a fabric enclosure forming a plurality of walls and defining an interior of said tent;

a frame positioned with respect to said fabric enclosure and configured to support said fabric enclosure, said frame comprising a first frame member aligned with a roof panel formed by said fabric enclosure, said first frame member having a first end portion positioned within a coupling device and a second frame member aligned with said first wall, and having an upper end portion positioned within said coupling device;

a first plurality of eve portions each coupled to said frame and extending outwardly from a first wall of said plurality of walls;

a second plurality of eve portions each coupled to said frame and extending outwardly from a second wall of said plurality of walls; and a cover coupled to the frame and each said eve portion, said cover configured to cover at least a portion of said fabric enclosure, each said eve portion having a first end portion positioned within said coupling device, at least a portion of each said eve portion aligned coaxially with said first frame member.

12. A tent in accordance with claim 11 wherein each said eve portion is straight.

13. A tent in accordance with claim 11 wherein each said eve portion is curved.

14. A tent in accordance with claim 11 wherein each said eve portion is configured to reduce rainfall contact with one of said first wall and said second wall.

15. A tent in accordance with claim 11 wherein each said eve portion is configured to provide shading to said tent from sunlight.

16. A tent in accordance with claim 15 wherein the shading prevents ultra-violet degradation of said first wall.

17. A tent comprising:

a fabric enclosure forming a first side wall, an opposing second side wall, and a roof comprising a first roof panel coupled to said first side wall, and a second roof panel coupled to said first roof panel and said second side wall;

a frame positioned with respect to said fabric enclosure and configured to support said fabric enclosure, said frame comprising:

a plurality of first frame members each extending along a width of one of said first roof panel and said second roof panel; and a plurality of second frame members each coupled to a corresponding first frame member of said plurality of first frame members and extending along a height of one of said first side wall and said second side wall;

a coupling device coupling each said second frame member to said corresponding first frame member;

a plurality of eve portions each coupled to said frame and extending outwardly from one of said first side wall and said second side wall, each said eve portion having a first end portion positioned within said coupling device, and at least a portion of each said eve portion aligned coaxially with said corresponding first frame member; and a cover coupled to said frame and said plurality of eve portions, said cover configured to cover at least a portion of said tent.

* * * * *